US008075059B2

(12) United States Patent
Kim

(10) Patent No.: US 8,075,059 B2
(45) Date of Patent: Dec. 13, 2011

(54) PORTABLE SEATING SYSTEM AND METHOD OF MANUFACTURE

(75) Inventor: Changsoo Kim, Wildwood, MO (US)

(73) Assignee: North Pole Limited, Hong Kong (HK)

( * ) Notice: Subject to any disclaimer, the term of this patent is extended or adjusted under 35 U.S.C. 154(b) by 0 days.

(21) Appl. No.: 11/467,458

(22) Filed: Aug. 25, 2006

(65) Prior Publication Data

US 2008/0122268 A1 May 29, 2008

(51) Int. Cl.
*A47C 4/00* (2006.01)

(52) U.S. Cl. ..... 297/378.12; 297/40; 297/452.63; 297/16.1

(58) Field of Classification Search ..... 297/16.1, 297/16.2, 17, 35, 40, 452.56, 452.63, 378.12, 297/378.1, 378.14
See application file for complete search history.

(56) References Cited

U.S. PATENT DOCUMENTS 878,889 A * 2/1908 Miller ..... 297/352
2,306,673 A * 12/1942 Tucker ..... 297/252
3,026,142 A * 3/1962 Holloway ..... 297/252
3,066,980 A * 12/1962 Clute ..... 297/252
3,205,008 A * 9/1965 Murray et al. ..... 297/452.63
3,994,529 A * 11/1976 Lippert ..... 297/252
4,603,902 A * 8/1986 Maloney ..... 297/35
4,746,166 A * 5/1988 Sadan ..... 297/17
4,799,731 A * 1/1989 Brown ..... 297/188.12
4,890,882 A * 1/1990 Harrington ..... 297/45
5,385,390 A * 1/1995 Freeman et al. ..... 297/380
5,395,154 A * 3/1995 Wang ..... 297/130
5,415,455 A * 5/1995 Geldbaugh ..... 297/45
5,433,502 A * 7/1995 Condorodis et al. ..... 297/17
5,496,092 A * 3/1996 Williams et al. ..... 297/250.1
5,498,054 A * 3/1996 Tomlinson ..... 297/16.2
5,580,130 A * 12/1996 Williams et al. ..... 297/352
5,588,570 A * 12/1996 Zirbel ..... 224/155
5,727,897 A * 3/1998 Liu ..... 403/205
5,735,571 A * 4/1998 Colondona ..... 297/35
5,961,178 A * 10/1999 Hodson ..... 297/17
6,164,726 A * 12/2000 Reeves et al. ..... 297/452.63
6,203,108 B1 * 3/2001 Mattison, Jr. ..... 297/352
D449,458 S * 10/2001 Malmanger et al. ..... D6/368
D468,548 S * 1/2003 Head, Jr. ..... D6/368
6,502,902 B1 * 1/2003 Romero ..... 297/352
6,592,187 B2 * 7/2003 Calvery ..... 297/352
6,631,938 B1 * 10/2003 Burns ..... 296/64
6,644,752 B2 * 11/2003 Takata ..... 297/452.56
6,662,981 B2 * 12/2003 McUmber ..... 224/155
6,729,690 B2 * 5/2004 Martin et al. ..... 297/423.12
D495,511 S * 9/2004 Dingess et al. ..... D6/368
6,824,186 B2 * 11/2004 Brown ..... 296/65.16
6,848,746 B2 * 2/2005 Gentry ..... 297/380
6,860,561 B2 * 3/2005 Takata ..... 297/378.1
RE39,022 E * 3/2006 Welsh ..... 224/155
7,017,991 B1 * 3/2006 Zin ..... 297/271.6

(Continued)

*Primary Examiner* — Sarah B McPartlin
(74) *Attorney, Agent, or Firm* — Armstrong Teasdale LLP

(57) ABSTRACT

A portable seating system includes a foldable seating frame and a flexible seating material that is coupled to the seating frame. The foldable seating frame includes a back assembly having at least one semirigid back slat, and a seat assembly that includes at least one semirigid seat slat. The back assembly is coupled to the seat assembly by a locking hinge assembly, and an adjustable grip assembly is coupled to the seat assembly. The locking hinge assembly allows the seating system to fold into a compact unit so that a user can easily carry the seating system.

19 Claims, 5 Drawing Sheets

U.S. PATENT DOCUMENTS 7,086,694 B1 * 8/2006 Huang ..... 297/39
7,185,948 B2 * 3/2007 Liu ..... 297/30
7,192,091 B1 * 3/2007 Ping Sheng ..... 297/378.1
7,219,955 B2 * 5/2007 Lu et al. ..... 297/58
7,273,249 B1 * 9/2007 Tseng et al. ..... 297/39
D555,947 S * 11/2007 Vestweber ..... D6/500
7,314,247 B1 * 1/2008 Chen et al. ..... 297/16.1
2006/0103177 A1 * 5/2006 Vergara et al. ..... 297/16.1
2007/0035169 A1 * 2/2007 Sawyer ..... 297/382

* cited by examiner

PORTABLE SEATING SYSTEM AND METHOD OF MANUFACTURE

BACKGROUND OF THE INVENTION

This invention relates generally to seating systems, and, more specifically, to seating systems that can be folded.

Individuals frequently attend events or gatherings where a comfortable seat is not available. For example, some sport fields or stadiums have hard metal or wooden bleachers that are not clean and not comfortable. At other times, the only place to sit is along a hillside or a gentle incline where there is grass or dirt. Accordingly, individuals desire options that can provide a more comfortable seating arrangement than provided.

BRIEF DESCRIPTION OF THE INVENTION

In one aspect, the present invention provides a portable seating system including a foldable seating frame having a back assembly that includes at least one semirigid back slat that coupled to a backside of the back assembly. The foldable seating frame also includes a seat assembly having at least one seat slat that is coupled to an underside of the seat assembly. The back assembly is coupled to the seat assembly by a locking hinge assembly. The system further includes a flexible seating material that is coupled to the foldable seating frame, and an adjustable grip assembly coupled to the seat assembly.

In another aspect, the present invention provides a foldable seating frame including a back assembly including at least one semirigid back slat, a seat assembly including at least one seat slat, and at least one adjustable grip assembly coupled to the seat assembly. The back assembly is coupled to the seat assembly by a locking hinge assembly. The seating frame also has a pair of arm rest assemblies including a first arm rest assembly and a second arm rest assembly. Each arm rest assembly is pivotably coupled to both the back assembly and the seat assembly, and the locking hinge assembly and the pair of pivotably coupled armrest assemblies are configured to fold the seating frame into a substantially narrow and/or flat frame.

In another aspect, the present invention provides a method for manufacturing a portable seating system. The method includes forming a back assembly by coupling a first back member to a first locking hinge, and coupling a second back member to a second locking hinge. The first back member is coupled to the second back member by at least one semirigid slat to a backside of the back assembly. The method further includes forming a seat assembly by coupling a first seat member to the first locking hinge, and coupling a second seat member to the second locking hinge. The first seat member is coupled to the second seat member by at least one slat to an underside of the seat assembly. The first and second locking hinges are connected with a pivot support.

DETAILED DESCRIPTION OF THE INVENTION

The present invention relates to a foldable seating frame. The present invention also relates to a portable seating system that includes a foldable seating frame and a flexible seating material. In an opened position, the seating material and the seating frame operate as a chair. In the closed position, the seating system is folded over and secured by the seating material into a compact unit, thus allowing a user to easily carry the seating system.

Figure 1:
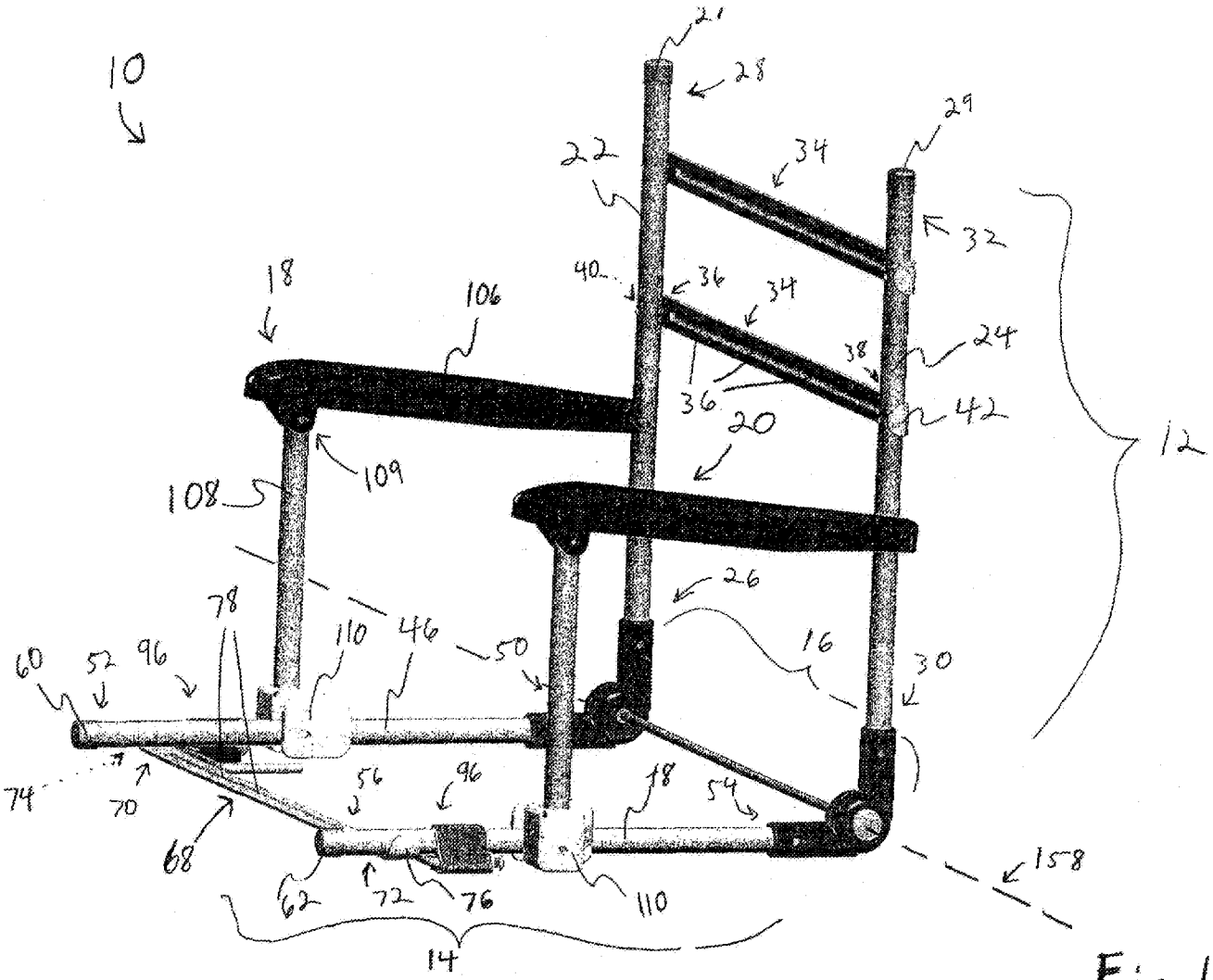
FIG. 1 is a perspective view of a seating frame.

As shown in FIG. 1, seating frame 10 includes a back assembly 12, a seat assembly 14, and a locking hinge assembly 16. In some embodiments, seating frame 10 includes at least one adjustable grip assembly 96 (discussed below). Furthermore, in some embodiments, seating frame 10 includes a pair of substantially aligned armrest assemblies 18, 20.

More specifically, back assembly 12 includes a pair of back members designated as a first back member 22 and a second back member 24. First back member 22 and second back member 24 are substantially aligned. In some embodiments, back members 22, 24 are substantially parallel. First back member 22 has two end portions 26, 28. Likewise, second back member 24 has two end portions 30, 32. For each back member 22, 24, each corresponding end portion 26, 30 couples to locking hinge assembly 16 (discussed further below). In some embodiments, corresponding end portions 28, 32 are covered by caps 27, 29, respectively.

Back members 22, 24 are constructed from a lightweight, durable material, such as a metal alloy. In other embodiments, the lightweight durable material is a plastic. It is apparent to those skilled in the art and guided by the teachings herein provided that any suitable lightweight, durable material may be used to construct embodiments of the present invention. In some embodiments, back members 22, 24 are hollow.

Back assembly 12 also includes at least one slat 34. As shown in FIG. 1, slat 34 is a substantially flat member. In some embodiments, slat 34 is semirigid, meaning that slat 34 is substantially rigid but allows some bending when an individual is using seating system 140. In some embodiments, slat 34 is rigid. In some embodiments, slat 34 is constructed from a lightweight, durable material that may or may not be the same material used to construct back members 22, 24. In some embodiments, slat 34 includes a concave indentation 36 extending substantially along a length of slat 34.

As shown in FIG. 1, slat 34 has two end portions 36, 38 that couple to first back member 22 and second back member 24, respectively. As seen in FIG. 1, slat 34 couples to an backside of first back member 22 and second back member 24. When flexible seating material 150 is coupled to seating frame 10, slat 34 provides additional support for a user sitting in a portable seating system 140 (discussed below).

In some embodiments, flanges 40, 42 extend from slat end portions 36, 38, respectively. As shown in FIG. 1, flanges 40, 42 partially surround and/or cover outer portions of first back member 22 and second back member 24. This configuration provides extra support to seating frame 10 by resisting forces that tend to separate back members 22, 24 of back assembly 12. As shown in FIG. 1, seat assembly 14 includes a pair of seat members designated as a first seat member 46 and a second seat member 48. First seat member 46 and second seat member 48 are substantially aligned. In some embodiments, seat members 46, 48 are substantially parallel. First seat member 46 has two end portions 50, 52. Likewise, second seat member 48 has two end portions 54, 56. For each seat member 46, 48, each corresponding end portion 50, 54 couples to locking hinge assembly 16 (discussed further below). In some embodiments, corresponding end portions 52, 56 are covered by caps 60, 62, respectively.

Seat members 46, 48 are constructed from a lightweight, durable material, such as a metal alloy. In other embodiments, the lightweight durable material is a plastic. It is apparent to those skilled in the art and guided by the teachings herein provided that any suitable lightweight, durable material may be used to construct embodiments of the present invention. Furthermore, all members, 22, 24, 46, 48 can each be constructed from a material different than the other members. In some embodiments, seat members 46, 48 are hollow.

Seat assembly 14 also includes at least one slat 68. As shown in FIG. 1, slat 68 is a substantially flat member. In some embodiments, slat 68 is semirigid, meaning that slat 68 is substantially rigid but allows some bending when an individual is using seating system 140. In some embodiments, slat 68 is rigid. In some embodiments, slat 68 is constructed from a lightweight, durable material that may or may not be the same material used to construct seat members 46, 48. In some embodiments, slat 68 includes a concave indentation 78 extending substantially along a length of slat 68.

As shown in FIG. 1, slat 68 has two end portions 70, 72 that couple to first seat member 46 and second seat member 48, respectively. As can be seen from the seating frame shown in FIG. 1, slat 68 couples to an underside of first seat member 46 and second seat member 48. When flexible seating material 150 is coupled to seating frame 10, slat 68 provides additional support and comfort for a user sitting in system 140 (discussed below).

In some embodiments, flanges 74, 76 extend from slat end portions 70, 72, respectively. As shown in FIG. 1, flanges 74, 76 partially surround and/or cover outer sides of first seat member 46 and second seat member 48. This can provide extra support to seating frame 10 by resisting any force to separate seat members 46, 48 of seat assembly 14. In some embodiments, slat 68 includes a concave indentation 78 extending substantially along a length of slat 68. Slat 68 is constructed from a lightweight, durable material that may or may not be the same material used to construct seat members 46, 48.

Figure 2A:
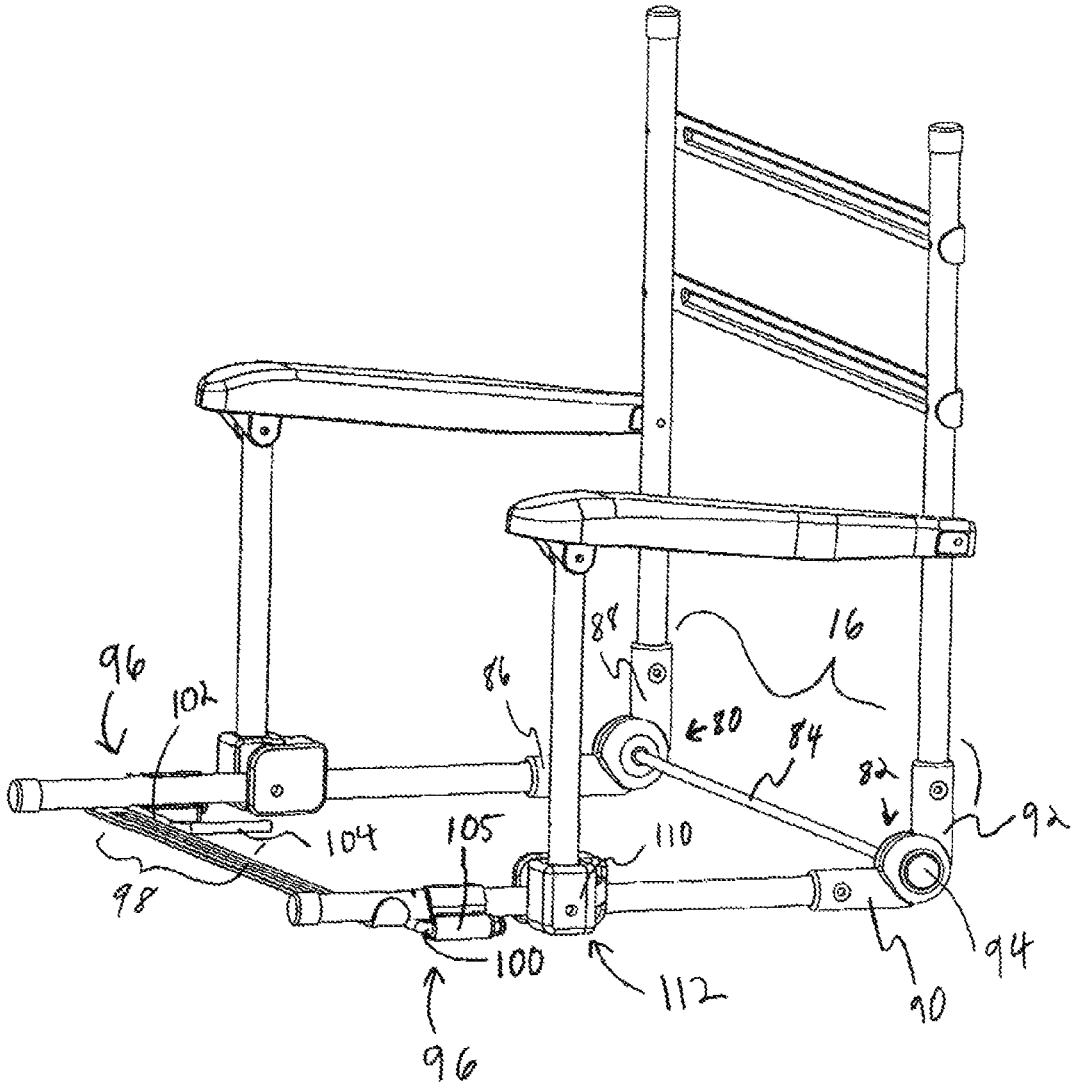
FIGS. 2*a*, 2*b*, and 2*c* provide a perspective view of the seating frame in FIG. 1 as the seating frame is folded.
Figure 2B:
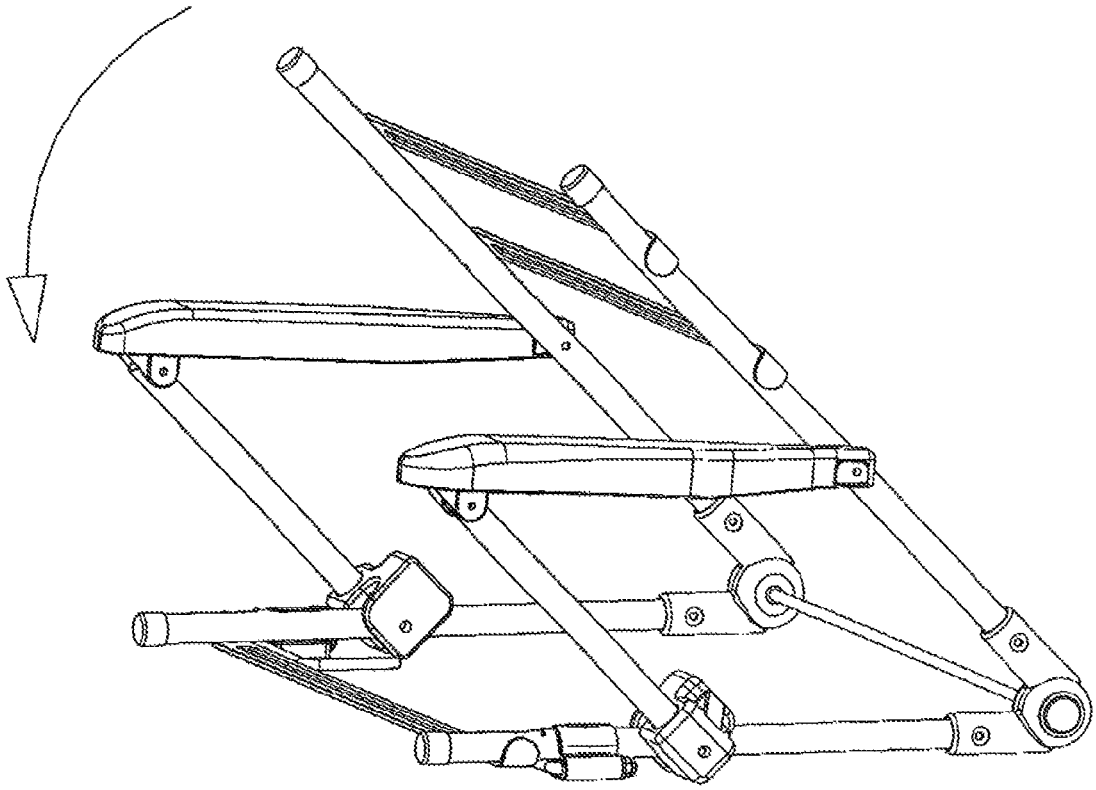
Figure 2C:
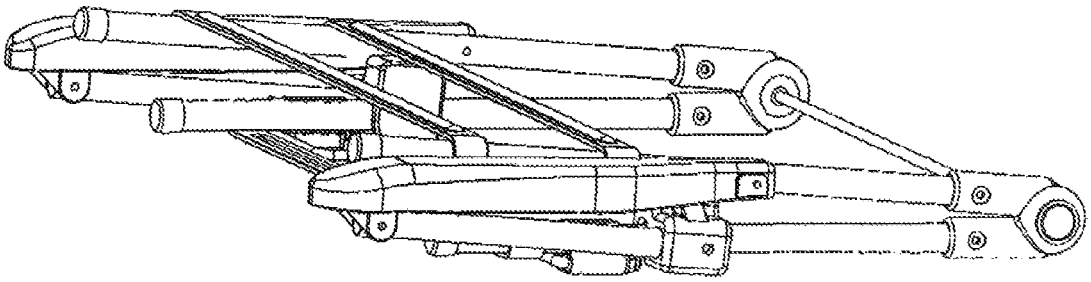

Locking hinge assembly 16 allows seating frame 10 to be folded along an axis 158 into a closed position so that system 140 can be easily carried (shown in FIGS. 2*a*, 2*b*, and 2*c*). In some embodiments, locking hinge assembly is partially positioned in substantially the same plane or slightly higher than a plane of seat assembly 14 allowing seating frame 10 or seating system 140 to be substantially narrow and/or flat when in a closed position (shown in FIG. 2*c*).

In some embodiments, locking hinge assembly 16 includes a pair of substantially aligned locking hinges designated as a first locking hinge 80 and a second locking hinge 82. In some embodiments, locking hinge assembly 16 includes a pivot support 84 coupled to locking hinges 80, 82 and extends along axis 158 (shown in FIGS. 2*a*-2*c*).

As discussed above, first locking hinge 80 couples to a corresponding end portion of back member and seat member. Likewise, second locking hinge 82 couples to a corresponding end portion of back member and seat member. In a final embodiment of seating frame 10, first locking hinge 80 and second locking hinge 82 are substantially aligned.

As discussed above, in some embodiments locking hinge assembly 16 further includes pivot support 84 that couples to both locking hinges 80, 82. Along with slats 34, 68, pivot support 84 provides additional structural strength to seating frame 10 and portable seating system 140. More specifically, pivot support 84 and slats 34, 68 operate together to keep the left side of seating frame 10 substantially aligned and coupled with the right side of seating frame 10. Furthermore, when in the closed position, slats 34, 68, and pivot support 84 provide a user of portable seating system 140 a suitable place to grasp when carrying an embodiment of the invention.

As shown in FIGS. 2*a*-2*c*, in some embodiments each locking hinge 80, 82 is constructed from two hinge parts 86, 88, and 90, 92, respectively. In some embodiments, each hinge part 86, 88, 90, 92 has a portion that couples to a member and a portion that couples to a corresponding hinge part. In some embodiments, each hinge part 86, 88, 90, 92 has a portion that operates as a sleeve to receive a member and a portion that complements and couples to a corresponding hinge part. In some embodiments, each hinge part 86, 88, 90, 92 of locking hinge assembly 16 is configured in the same shape allowing for a simpler and more cost effective construction of seating frame 10.

At least one of locking hinges 80, 82 has an unlocking trigger 94. As shown in FIG. 2*a*, in one embodiment, trigger 94 is a push-button. A user of portable seating system 140 who wishes to fold seating system 140 into a closed position presses the at least one trigger 94 to unlock locking hinges 80, 82 to allow the user to fold seating system 140. In one embodiment, each locking hinge 80, 82 has an unlocking trigger 94.

In some embodiments, a first side of seating frame 10 includes first back member 22, first seat member 46, and first locking hinge 80. A second side of seating frame 10 includes second back member 24, second seat member 48, and second locking hinge 82. Each side of seating frame 10 couples to the other by at least slats 34, 68 and by pivot support 84. In some embodiments, each side of seating frame 10 couples to the other only by slats 34, 68 and by pivot support 84 (and, optionally, flexible seating material 150 for seating system 140). In some embodiments, back members 22, 24 do not bend and extend into each other at end portions 28, 32, and/or seat members 46, 48 do not bend and extend into each other at end portions 52, 56.

In some embodiments of the invention, seating frame 10 is attached to a raised and substantially flat surface (e.g., bleacher, bench, or other seat), and therefore offers a user a more comfortable seating option. In some embodiments of the invention, seating frame 10 grips the raised flat surface by at least one adjustable grip assembly 96 coupled to seat assembly 14. In some embodiments, each of seat members 46, 48 are separately coupled to a grip assembly 96.

Generally, grip assembly 96 is any part or assembly that grips a portion of a bench, bleacher, seat, or other raised, substantially flat surface where a person could sit. In one embodiment, grip assembly 96 includes a grip 98 having a coupled portion 100, a transversal portion 102, and an axial portion 104.

Coupled portion 100 of grip 98 is coupled to a holder 105 of grip assembly 96. Coupled portion 100 is substantially parallel to an axis of the corresponding seat member. Transversal portion 102 connects or extends from coupled portion 100 and runs away from coupled portion 100. The length of transversal portion 102 is about 2 to about 5 inches. Transversal portion 102 then connects or extends into axial portion 104. While in use, axial portion 104 would be underneath the bench, bleacher, seat, or other raised, substantially flat surface. Transversal portion 102 and axial portion 104 act together in forming a grip that holds onto a bench, bleacher, seat, or other raised, substantially flat surface so that a user of seating frame 10 or portable seating system 140 will not fall backward.

In operating grip assembly 96, a user rotates grip 98 along an axis of coupled portion 100, thereby lowering transversal and axial portions 102, 104 of grip 98. When transversal and axial portions 102, 104 of grip 98 are lowered, grip 98 holds or grab onto a bench, bleacher, or seat. In order to grip the seat with grip 98, a user rotates grip 98 to lower transversal and axial portions 102, 104, then places seating frame 10 or seating system 140 on the bench, bleacher, or seat and slides seating frame 10 or seating system 140 backward until grip 98 catches the bench, bleacher, or seat.

In some embodiments of the invention, seating frame 10 and portable seating system 140 include a pair of substantially aligned armrest assemblies (designated as a first armrest assembly 18 and a second armrest assembly 20). As shown in FIG. 1, each armrest assembly 18, 20 includes an armrest support 106, an armrest member 108, and a rotatable connector 110. Armrest support 106 is pivotably coupled to armrest member 108 at one end portion, and pivotably coupled at the other end portion to a corresponding back member. In addition to being coupled to armrest support 106, armrest member 108 is also coupled to rotatable connector 110, which is coupled to a corresponding seat member.

As shown in FIG. 1, when seating frame 10 is in the opened position, armrest member 108 is about ninety degrees with respect to armrest support 106, although it is within the scope of this invention for embodiments to have armrest member 108 be greater than on less than ninety degrees in relation to armrest support 106 when seating frame 10 is in the opened position. In some embodiments, armrest member 108 is pivotably coupled to a protrusion 109 extending from armrest support 106. In some embodiments, armrest member 108 is pivotably coupled to armrest support 106, such that both armrest member 108 and armrest support 106 are substantially within the same plane.

As shown in FIGS. 2*a*-2*c*, in some embodiments as seating frame 10 or seating system 140 is moved from an opened position to a closed position, each pivotably coupled support 106 and member 108 of first armrest assembly 18 folds in alignment with each pivotably coupled support 106 and member 108 of second armrest assembly 20. In some embodiments, when in the closed position each protrusion 109 is in alignment. In some embodiments, locking hinge assembly 16 and pivotably coupled armrest assemblies 18, 20 are configured to operate together in folding seating frame 10 or seating system 140 into a substantially narrow and/or flat frame or system.

Rotatable connector 110 is constructed from a lightweight durable material, such as a metal alloy or plastic, and coupled to a seat member. As shown in FIG. 2*a*, when seating frame 10 and portable seating system 140 are in the open position, rotatable connector 110 has a flat surface 112 that lies on the surface of the bleacher, bench, or other seat. Along with the width of rotatable connector 110, flat surface 112 provides support to portable seating system 140 and, consequently, to a user of the seating system. Furthermore, rotatable connector 110 can also prevent portable seating system 140 from slipping forward on a bench, bleach, or any seat that might have a ridge on the edge of the seat.

As shown in FIG. 1, in some embodiments, armrest assemblies 18, 20 are coupled on the outside of the left and right sides. This coupling provides additional support and structural strength to seating frame 10 and portable seating system 140 and also allows greater comfort for the user of portable seating system 140. This coupling also allows seating system 140 to be easily folded without armrest assemblies prohibiting system 140 from collapsing almost completely (as shown in FIG. 2).

When seating frame 10 and portable seating system 140 are closed, armrest assemblies 18, 20 fold such that armrest support 106 is positioned over armrest member 108 and rotatable connector 110 (shown in FIG. 2).

Figure 5:
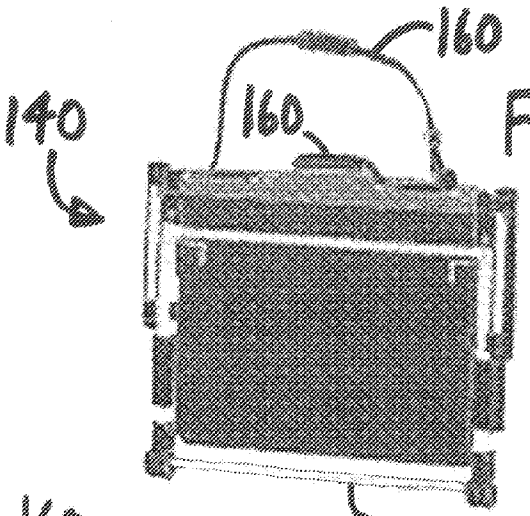
FIG. 5 is another perspective view of the portable seating system from FIG. 3 in a closed position.
Figure 4:
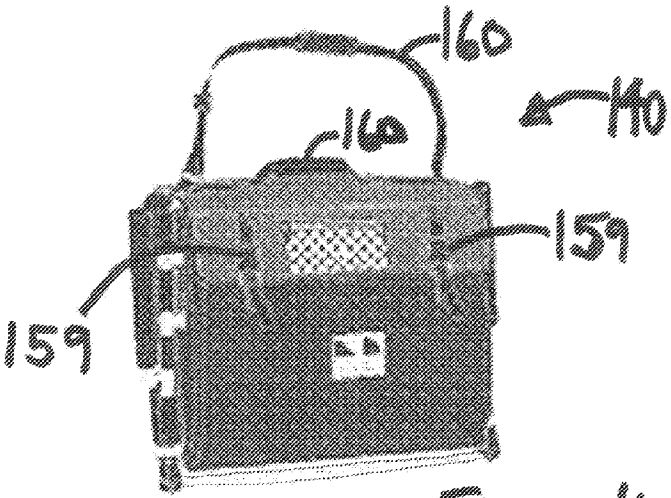
FIG. 4 is a perspective view of the portable seating system from FIG. 3 in a closed position.
Figure 3:
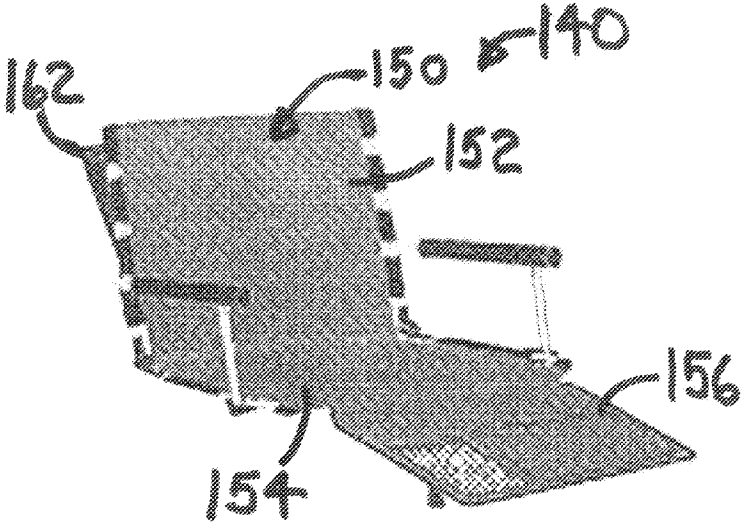
FIG. 3 is a perspective view of a portable seating system in an opened position.

Portable seating system 140 as shown in FIGS. 3-5 includes a foldable seating frame 10 and a flexible seating material 150 coupled to seating frame 10. In some embodiments, flexible seating material 150 can be any material that is flexible and suitable for sitting upon, such as canvas. Furthermore, flexible material 150 can include more than one material.

As shown in FIGS. 3-5, seating material 150 is coupled to seating frame 10 and is positioned on a side of slats 34, 68. Seating material 150 and slats 34, 68 operate together to provide a more comfortable seating system for the user because the front of slats 34, 68 are substantially flat and positioned on the backside of back assembly 12 and underside of seat assembly 14, respectively. Unlike other seating systems with bars in the same plane of the back assembly or seat assembly, slats 34, 68 provide extra support without an uncomfortable pressing of the bars into the user's upper back or legs.

In some embodiments, seating material 150 is coupled to seating frame 10 and is positioned on a side of slats 34, 68, and on or under pivot support 84.

In some embodiments, flexible seating material 150 includes a back section 152, a seat section 154, and an overhang section 156. In some embodiments, back section 152 extends into seat section 154. In some embodiments, seat section 154 extends into overhang section 156. In other embodiments, each section 152, 154, 156 is separate from each other.

While in an opened position, overhang section 156 operates to protect a user of the seating system 140 from a wind coming from behind the user, and can prevent a user's legs from touching things below the seat, such as concrete. Furthermore, if seating system 140 is on the side of a hill or slight incline, overhang section 156 protects a user's legs from grass or dirt.

As shown in FIGS. 4 and 5, the backside of overhang section 156 and the backside of back section 152 includes a fastener means 159. Fastener means 159, in some embodiments, is any type of fastener or fasteners (e.g., snaps, straps, or Velcro®) provided that fastener means 159 secures or removably attaches overhang section 156 to a backside of back section 152. It is apparent to those skilled in the art and guided by the teachings herein provided that many types of fasteners and other means for securing exist that will operate as fastener means 159 for removably attaching overhang section 156 to the backside of back section 152.

Furthermore, the backside of overhang section 156 is optionally attached to at least one carrying device 160. For example, and as shown in FIGS. 4 and 5, seating system 140 includes a handle and/or shoulder strap.

As shown in FIG. 3, in some embodiments, back section 152 includes a pouch 162. Pouch 162 is not necessarily made of the same material as seating material 150, but the pouch material must at least be able to form a pouch. In some embodiments, pouch 162 is made from the same material as back section 156. In some embodiments, pouch 162 is made of canvas. It is apparent to those skilled in the art and guided by the teachings herein provided that many types of material and many configurations are suitable for making pouch 162.

The scope of the present invention also includes a method for manufacturing a seating frame and a seating system, similar to seating frame 10 and seating system 140 described above. The method includes forming a back assembly 12 by coupling a first back member 22 to a first locking hinge 80, a second back member 24 to a second locking hinge 82, and connecting the first back member 22 and the second back member 24 with at least one slat 34.

The method for manufacturing a seating frame also includes forming a seat assembly 14 by coupling a first seat member 46 to the first locking hinge 80, a second seat member 48 to the second locking hinge 82, and connecting the first seat member 46 to the second seat member 48 with at least one slat 68. The first locking hinge 80 is then coupled to the second locking hinge 82 with a pivot support 84. The method further includes coupling armrest assemblies 18, 20 to the outside of the left and right sides of the seating system.

In order to manufacture a portable seating system, a flexible seating material 150 is coupled to the seating frame 10. In one embodiment, the flexible seat material 150 includes or is coupled to at least one carrying device 160, at least one pouch 162, and at least one fastener means 159.

Exemplary embodiments of seating frames and portable seating systems, as well as methods for manufacturing are described and/or illustrated above in detail. The frames, systems, and methods are not limited to the specific embodiments described herein, but rather, components of each frame and system, and steps of each method may be utilized independently and separately from other frames, systems, and steps described herein. Each frame and/or system component and method step can also be used in combination with other frame and/or system components and/or method steps.

While the invention has been described in terms of various specific embodiments, those skilled in the art will recognize that the invention can be practiced with modification within the spirit and scope of the claims.

What is claimed is:

1. A portable seating system comprising:

a foldable seating frame comprising a back assembly comprising at least one semirigid back slat coupled to a backside of said back assembly, a seat assembly comprising at least one seat slat coupled to an underside of said seat assembly, and a locking hinge assembly directly coupling said back assembly to said seat assembly, said locking hinge assembly comprising:

a first locking hinge directly coupling a first side of said back assembly to a corresponding first side of said seat assembly;

a second locking hinge directly coupling a second side of said back assembly to a corresponding second side of said seat assembly;

a pivot structure coupled between said first locking hinge and said second locking hinge, and having a center axis generally extending along an axis of rotation of said first locking hinge and said second locking hinge; and an unlocking trigger coupled to at least one of said first locking hinge and said second locking hinge, said unlocking trigger unlockable to enable said foldable seating frame to be folded, said unlocking trigger oriented to actuate in a direction generally coaxial with the center axis such that said pivot structure provides structural strength to said unlocking trigger;

a flexible seating material coupled to said seating frame; and an adjustable grip assembly coupled to said seat assembly.

2. A system according to claim 1 wherein said back assembly further comprises at least two semirigid back slats.

3. A system according to claim 2 wherein said back assembly further comprises at least two semirigid back slats, each said back slat having a concave indentation extending substantially along a length of each said back slat.

4. A system according to claim 2 wherein said back assembly further comprises at least two semirigid back slats, each said back slat having flanges extending from end portions of said back slat.

5. A system according to claim 1 wherein said first locking hinge comprises two hinge parts, said two hinge parts configured in substantially the same shape.

6. A system according to claim 1 wherein said flexible seating material comprises an overhang section, a back section, and at least one fastener for securing said overhang section to said back section when said seating frame is in a closed position.

7. A system according to claim 1 wherein said back assembly comprises a first side and a second side, wherein said at least one semirigid back slat couples said first side to said second side.

8. A foldable seating frame comprising:

a back assembly comprising at least one semirigid back slat coupled to a backside of said back assembly;

a seat assembly comprising at least one seat slat coupled to an underside of said seat assembly;

a locking hinge assembly directly coupling said seat assembly to said back assembly, said locking hinge assembly comprising:

a first locking hinge coupling a first side of said back assembly to a corresponding first side of said seat assembly;

a second locking hinge coupling a second side of said back assembly to a corresponding second side of said seat assembly;

a pivot structure coupled between said first locking hinge and said second locking hinge, said pivot structure having a center axis generally extending along an axis of rotation of said first locking hinge and said second locking hinge; and an unlocking trigger coupled to at least one of said first locking hinge and said second locking hinge, said unlocking trigger unlockable to enable said foldable seating frame to be folded, said unlocking trigger oriented to actuate in a direction generally coaxial with the center axis such that said pivot structure provides structural strength to said unlocking trigger;

at least one adjustable grip assembly coupled to said seat assembly;

a first arm rest assembly pivotally coupled to a first side of said seat assembly and a first side of said back assembly; and a second arm rest assembly pivotally coupled to a second side of said seat assembly and a second side of said back assembly, wherein said locking hinge assembly is configured to operate with at least one of said first arm rest and said second arm rest to facilitate moving said seating frame into a folded configuration.

9. A seating frame according to claim 8 wherein said back assembly includes at least two semirigid slats.

10. A seating frame according to claim 9 wherein each semirigid slat of said at least two semirigid slats has concave indentations extending substantially along a length thereof.

11. A seating frame according to claim 9 wherein each semirigid slat of said at least two semirigid slats has flanges extending from end portions thereof.

12. A seating frame according to claim 8 wherein each of said first arm rest assembly and said second arm rest assembly comprises an arm rest support.

13. A seating frame according to claim 8 wherein said first sides of said back assembly and said seat assembly couple to said second sides of said back assembly and said seat assembly by said slats.

14. A method for manufacturing a portable seating system, said method comprising:

forming a back assembly by directly coupling a first back member to a first locking hinge, a second back member to a second locking hinge, and coupling the first back member and the second back member with at least one semirigid back slat;

forming a seat assembly by directly coupling a first seat member to the first locking hinge, a second seat member to the second locking hinge, and coupling the first seat member to the second seat member with at least one seat slat;

coupling the first locking hinge to the second locking hinge with a pivot support, the pivot support coupled between the first locking hinge and the second locking hinge and having a center axis generally extending along an axis of rotation of the first locking hinge and the second locking hinge; and coupling an unlocking trigger to at least one of the first locking hinge and the second locking hinge, the unlocking trigger unlockable to enable the portable seating system to be folded, the unlocking trigger oriented to actuate in a direction generally coaxial with the center axis such that the pivot support provides structural strength to the unlocking trigger.

15. A method according to claim 14 wherein the at least one back slat has flanges extending from end portions of the at least one back slat that partially surround a corresponding one of the first back member and the second back member.

16. A method according to claim 15 wherein the at least one back slat has a concave indentation extending substantially along a length of the at least one back slat.

17. A method according to claim 16 wherein the back assembly comprises at least two semirigid back slats.

18. A method according to claim 14 further comprising coupling an armrest assembly between the first back member and the first seat member.

19. A portable seating system comprising:

a seating frame comprising a back assembly comprising at least one semirigid back slat coupled to said back assembly, a seat assembly comprising at least one seat slat coupled to said seat assembly, and a locking hinge assembly pivotally coupling said back assembly to said seat assembly, said locking hinge assembly comprising:

a first locking hinge coupling a first side of said back assembly to a corresponding first side of said seat assembly;

a second locking hinge coupling a second side of said back assembly to a corresponding second side of said seat assembly;

a pivot structure coupled between said first locking hinge and said second locking hinge, and having a center axis generally extending along an axis of rotation of said first locking hinge and said second locking hinge; and an unlocking trigger coupled to at least one of said first locking hinge and said second locking hinge, said unlocking trigger unlockable to enable said seating frame to be folded, said unlocking trigger oriented to actuate in a direction generally coaxial with the center axis such that said pivot structure provides structural strength to said unlocking trigger.

* * * * *